United States Patent [19]

Brull

[11] Patent Number: 4,646,484

[45] **Date of Patent: * Mar. 3, 1987**

[54] CRYOGEN SHOT BLAST DEFLASHING APPARATUS WITH INERT GAS PURGING SYSTEM

[75] Inventor: John J. Brull, Chagrin Falls, Ohio

[73] Assignee: AGA AB, Sweden

[ * ] Notice: The portion of the term of this patent subsequent to May 28, 2002 has been disclaimed.

[21] Appl. No.: 735,386

[22] Filed: May 17, 1985

Related U.S. Application Data

[63] Continuation-in-part of Ser. No. 546,431, Oct. 28, 1983.

[51] Int. Cl.[4] ..... B24C 3/04

[52] U.S. Cl. ..... 51/436; 51/423; 51/322

[58] Field of Search ..... 51/410, 422, 423, 425, 51/163.1, 164.1, 314, 319, 322, 436

[56] References Cited

U.S. PATENT DOCUMENTS

| | | | |
|---|---|---|---|
| 3,432,968 | 3/1969 | Croft et al. | 51/415 |
| 3,824,739 | 7/1974 | Monet et al. | 51/424 |
| 4,519,812 | 5/1985 | Brull et al. | 51/425 |
| 4,524,548 | 6/1985 | Klee et al. | 51/322 |

*Primary Examiner*—Frederick R. Schmidt
*Assistant Examiner*—Robert A. Rose
*Attorney, Agent, or Firm*—David A. Burge

[57] ABSTRACT

A closed recirculation cryogen shot blast deflashing apparatus includes an upstanding frame which movably supports a receptacle assembly including an enclosure having a housing enshrouding a rotatable drum, and a door thereon pivotable between positions wherein the door selectively opens and closes an open outer end of the drum. A throwing wheel is carried on the door for discharging particulate media and cryogen gas into the drum for impacting workpieces and embrittling workpiece flash. A recirculation system is provided for withdrawing cryogen gas and particulates from the drum during operation of the machine, for separating reusable particulate media from particles of waste material, and for returning a controlled flow of pressurized cryogen gas and particulate media to the throwing wheel, including a blower for recirculating cryogen gas to the throwing wheel from the drum by evacuating cryogen from the drum through a return conduit, and by redelivering pressurized cryogen to the throwing wheel through a supply conduit, whereby the blower cooperates with the throwing wheel to establish the desired high velocity flow of cryogen gas through the drum. A purging system introduces an inert gas such as nitrogen at spaced locations throughout the closed system of the deflashing apparatus to purge the apparatus of ambient air before cryogen introduction is begun, and to maintain a positive pressure inert atmosphere throughout the apparatus to inhibit entry of moisture laden ambient air.

32 Claims, 12 Drawing Figures

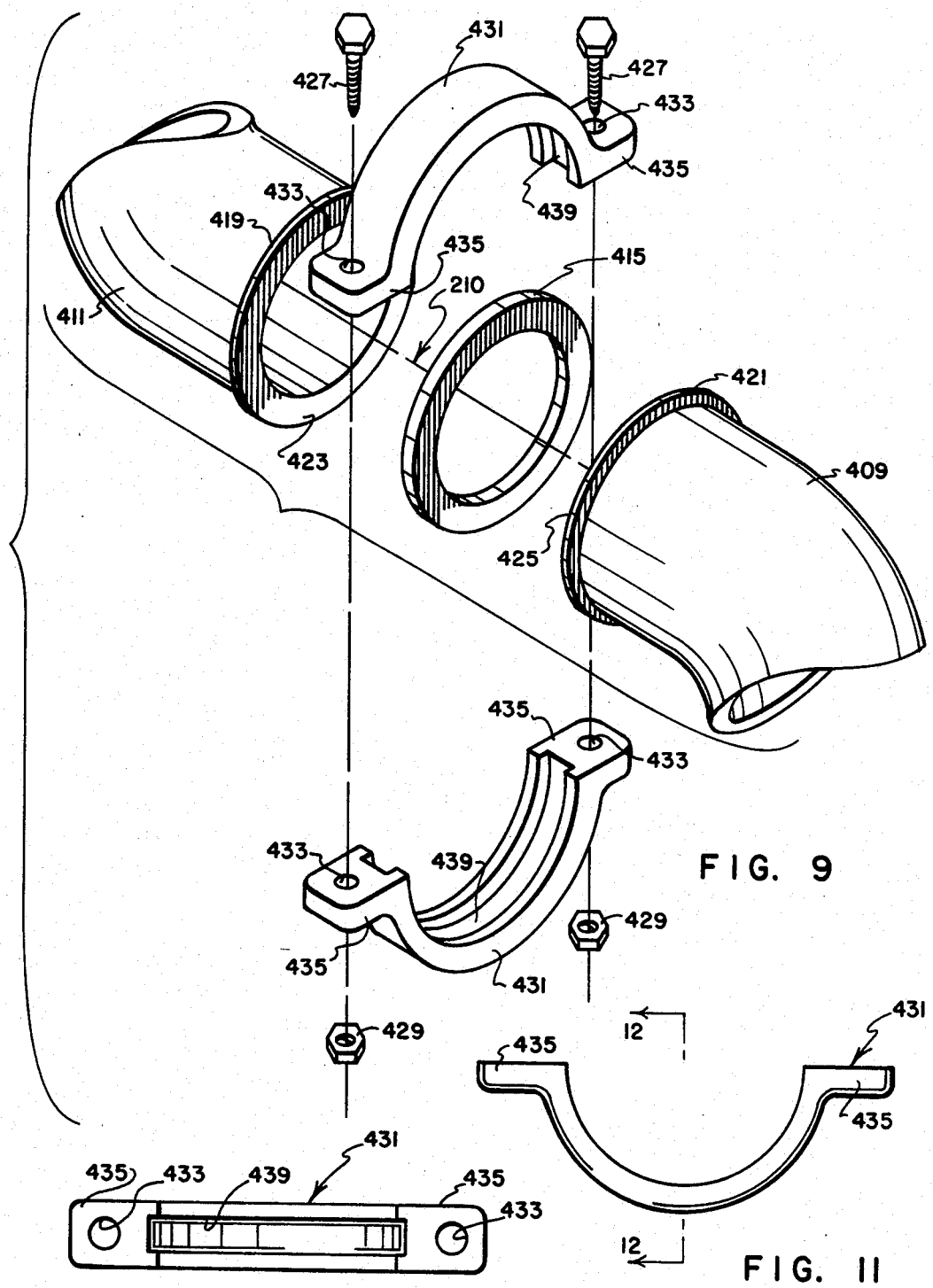
FIG. 9
FIG. 10
FIG. 11
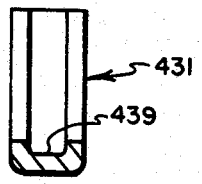
FIG. 12

CRYOGEN SHOT BLAST DEFLASHING APPARATUS WITH INERT GAS PURGING SYSTEM

CROSS-REFERENCE TO RELATED APPLICATIONS

The present application is a continuation-in-part of an application entitled CRYOGEN SHOT BLAST DEFLASHING SYSTEM, filed Oct. 28, 1983, Ser. No. 546,431, by John J. Brull and Robert E. Schmitz, hereinafter referred to as the "Apparatus Case," the disclosure of which is incorporated herein by reference.

Reference is also made to the following applications that were filed concurrently with the Apparatus Case and that relate to developments made concurrently with the invention of the Apparatus Case, the disclosures of which are incorporated herein by reference, namely:

CRYOGEN SHOT BLAST DEFLASHING SYSTEM WITH JOINTED SUPPLY CONDUIT, filed Oct. 28, 1983, Ser. No. 546,429, by John J. Brull and Michael T. Carnahan, issued May 28, 1985 as U.S. Pat. No. 4,519,812, hereinafter referred to as the "Jointed Supply Conduit Case;" and, CRYOGEN SHOT BLAST DEFLASHING SYSTEM WITH BELLOWS RETURN CONDUIT, filed Oct. 28, 1983, Ser. No. 546,430, by Gilbert J. Vasek, now U.S. Pat. No. 4,598,501, hereinafter referred to as the "Bellows Return Conduit Case."

BACKGROUND OF THE INVENTION

1. Field of the Invention

The present invention relates generally to the art of removing flash from workpieces which have been molded from such flexible materials as rubber, plastics, and the like. More particularly, the present invention relates to a closed recirculation cryogen shot blast deflashing apparatus which, in its preferred form, (1) moves workpieces to be deflashed about in a treatment chamber, (2) exposes the workpieces in the treatment chamber to a high velocity flow of cryogen gas (preferably nitrogen) to rapidly embrittle workpiece flash, (3) impacts workpieces in the treatment chamber with particulate media which is projected from a throwing wheel to remove embrittled flash from the workpieces, (4) recirculates cryogen gas and particulate media from and to the treatment chamber in a highly efficient manner, (5) utilizes a recirculating flow of pressurized cryogen gas to act as a carrier for particulate media being delivered to the throwing wheel, and (6) employs a purging system for introducing an inert gas such as nitrogen into the closed recirculation system of the deflashing apparatus to purge the apparatus of ambient air before cryogen introduction is begun, and to maintain a positive pressure inert atmosphere throughout the apparatus to inhibit entry of moisture laden ambient air and thereby prevent condensation of moisture and the formation of ice inside the apparatus.

2. Prior Art

When articles are molded from flexible materials such as rubber, plastics and the like, the resulting articles often have thin pieces of unwanted flexible material extending therefrom called "flash" which must be removed to conform the articles to their desired final configurations. Removing flash from articles formed from flexible materials is difficult in view of the soft, elastic nature of the flexible materials. While various types of mechanical trimming operations have been proposed for use in extricating unwanted flash, these proposals have proven not to be economically feasible in a majority of applications.

In order to simplify and reduce the cost of flash removal, proposals of various types have been made for "freezing" or otherwise cooling molded articles to embrittle their thin sections of flash, whereafter one or a combination of mechanical processes have been utilized to break off, trim or otherwise remove the "frozen" or embrittled flash.

The use of cryogen materials such as liquid nitrogen to effect embrittlement of workpiece flash is known. As utilized herein, the term "cryogen" will be understood to refer broadly to substances which are fluids and are at temperatures of about −60° F. and below.

The use of shot blast deflashing machinery in single and plural stage processes to remove cryogen-embrittled flash is known. Previous proposals for cryogen shot blast deflashing apparatus have been characterized by a number of drawbacks. Proposed apparatus typically have been of complex and expensive construction, and have exhibited less than the desired degree of reliability. Such systems as have been proposed for (1) withdrawing particulates including media and pieces of flash from treatment chambers, (2) segregating reusable media, and (3) returning the reusable media to throwing wheels have not functioned entirely satisfactorily. A problem quite common to apparatus embodying previous proposals is that ambient air which contains moisture is able to enter the system, whereupon in the cold cryogen environment of the system, the moisture condenses and forms ice that results in clogged and/or "frozen" flow lines and valves.

In short, most previously proposed cryogen shot blast deflashing apparatus have been quite costly to build, costly to maintain, and costly to operate; moreover, their operation has been undependable in that it has been characterized by undesirably frequent and lengthy intervals of machine "down time."

3. The Referenced Applications

The invention of the referenced Apparatus Case addresses the foregoing and other drawbacks of previously proposed cryogen deflashing systems, and provides a novel and improved cryogen deflashing system which is greatly simplified in construction and arrangement, and which operates with significantly improved efficiency. While the referenced Apparatus Case notes the need to maintain a cryogen atmosphere throughout the closed system of the apparatus to prevent entry of moisture laden ambient air and to prevent moisture condensation and ice formation, the Apparatus Case does not specifically call for the provision of an inert gas purging system that utilizes a gas such as nitrogen to purge the system of ambient air prior to the introduction of cryogen, and to maintain a positive pressure inert atmosphere throughout the apparatus to inhibit entry of moisture laden ambient air and thereby prevent condensation of moisture and the formation of ice. The present invention addresses this need by providing such a purging system, with the purging system including significant features that have been developed and proven through experimentation.

The referenced Bellows Return Conduit Case and the referenced Jointed Supply Conduit Case relate to recirculation and supply conduit features that are utilized in the deflashing system of the referenced Apparatus Case.

The features that form the subject matter of these applications are described and illustrated in the parent Apparatus Case, and are likewise described and illustrated herein for completeness and to satisfy the "best mode" description requirement of the patent law.

SUMMARY OF THE INVENTION

The present invention provides a novel and improved cryogen shot blast deflashing apparatus which is efficient and reliable in operation, and which includes a novel and improved purging system for maintaining a positive pressure inert gas environment within the closed recirculation system of the deflashing apparatus to purge the system of moisture laden ambient air prior to the introduction into the system of cryogen, and to inhibit entry of ambient air into the system and thereby prevent condensation of moisture and the formation of ice. By utilizing a closed system that minimizes the escape and waste of cryogen, and by maintaining a positive pressure inert gas atmosphere throughout the system, entry of moisture laden ambient air and moisture into the system is prevented as are condensation and freezing of moisture, whereby the cost of operating the unit is kept at a minimum, as is machine damage and down time.

In accordance with the preferred practice of the invention, a closed recirculation cryogen deflashing apparatus includes an upstanding frame supports a receptacle assembly which includes an enclosure that at least partially enshrouds a rotatable drum. The drum defines a treatment chamber, and has an access opening for charging workpieces into and removing workpieces from the drum. The enclosure also includes a door which is pivotally mounted on the housing for movement between positions wherein the door selectively opens and closes the access opening. The door carries a throwing wheel for projecting particulate media into the drum to impact contents of the drum. A recirculating system is provided for withdrawing cryogen gas and particulate materials from the drum during operation of the machine, for segregating reusable particulate media from other withdrawn particulates such as pieces of flash, and for returning a mixture of pressurized cryogen gas and particulate media through a supply conduit to the throwing wheel.

In order to provide a system which not only minimizes the escape of cryogen during system operation, but which enables particulate media and cryogen gas to be withdrawn readily from the workpiece treatment chamber for recirculation, a closed, positive pressure atmosphere is maintained throughout the system. A purging system is provided that does much to contribute to the maintenance of a positive pressure, moisture free atmosphere within the apparatus. The purging system acts to introduce an inert gas such as nitrogen into the apparatus at a plurality of locations that have been determined through experimentation as being optimum positions for introducing inert gas so that the system can both be purged of moisture laden ambient air prior to the initiation of cryogen introduction, and that can be utilized to maintain a positive pressure inert gas atmosphere throughout the apparatus to prevent entry of ambient air and condensation of moisture and/or ice formation. When cryogen shot blast deflashing is terminated, the purging system continues its operation for up to two hours as may be needed to assure that moisture laden ambient air continues to be excluded from the apparatus until the components of the apparatus are sufficiently warm to assure that the entry of ambient air will cause no difficulty or damage.

In accordance with the preferred practice of the present invention, nitrogen gas is introduced into the previously described cryogen shot blast apparatus utilizing essentially two types of purging inlets: the first type includes relatively low-flow-rate, low pressure nitrogen inlets that are positioned (1) in a treatment-chamber-to-blower cryogen recirculation conduit, (2) in a separator that is used to withdraw shot blast media from the treatment chamber and to separate the media for reuse from particles of workpiece flash, and (3) in a media supply hopper that forms part of a supply system for delivering media to the treatment chamber; the second type includes a single relatively high-flow-rate, higher pressure inlet for introducing nitrogen gas centrally into the workpiece treatment chamber when the door to the chamber is open. The relatively low pressure inlets preferably operate at a pressure that is about five pound per square inch above the pressure of ambient air, and cooperate to maintain a positive pressure inert gas atmosphere throughout the closed recirculation system of the apparatus. The higher pressure treatment chamber inlet preferably operates at a pressure that is about ten pounds per square inch above the pressure of ambient air, and serves to introduce nitrogen gas into the treatment chamber at a flow rate that will effectively minimize entry into the treatment chamber of ambient air when the treatment chamber door is open. In preferred practice, the treatment chamber inlet utilizes a hole formed centrally through the shaft that mounts the rotating drum.

BRIEF DESCRIPTION OF THE DRAWINGS

These and other features and a fuller understanding of the invention may be had by referring to the following description and claims, taken in conjunction with the accompanying drawings, wherein:

FIG. 9 is an exploded perspective view of components of a supply line joint utilized in preferred practice;

FIGS. 10 and 11 are top plan and side elevational views, respectively, of a component of the supply line joint; and, FIG. 12 is a sectional view as seen from a plane indicated by a line 12—12 in FIG. 11.

DESCRIPTION OF THE PREFERRED EMBODIMENT

Figure 1:
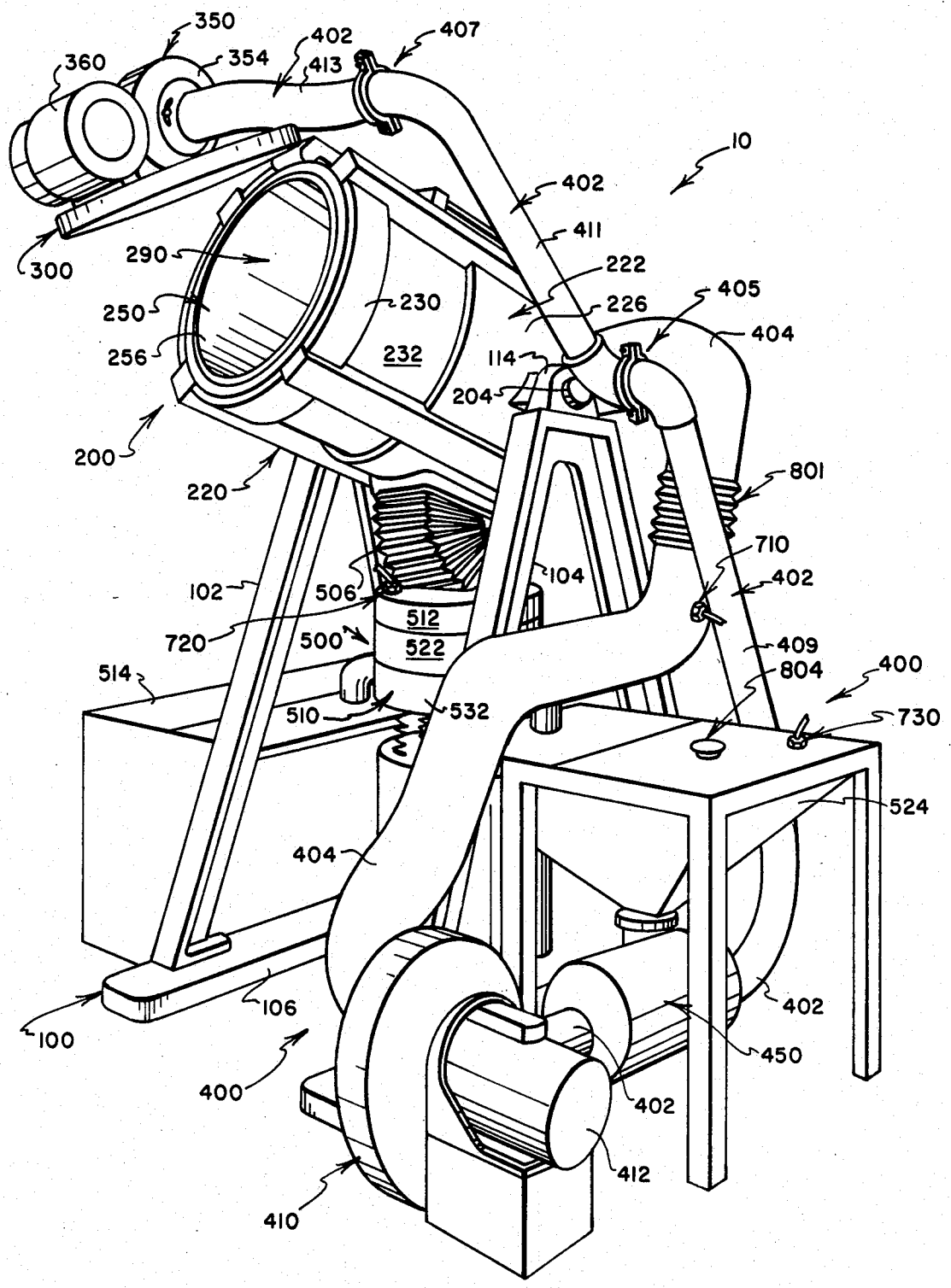
FIG. 1 is a perspective view of a cryogen shot blast deflashing machine incorporating the preferred practice of the present invention, with the machine having its treatment receptacle in an upwardly oriented position with its door open to receive workpieces to be deflashed.

Referring to FIGS. 1–6, a cryogen shot blast deflashing apparatus incorporating the preferred practice of the present invention is indicated generally by the numeral 10. The apparatus 10 includes an upstanding frame structure indicated generally by the numeral 100, a workpiece treatment receptacle assembly indicated generally by the numeral 200, and a supply and recirculation system indicated generally by the numeral 400.

Figure 5:
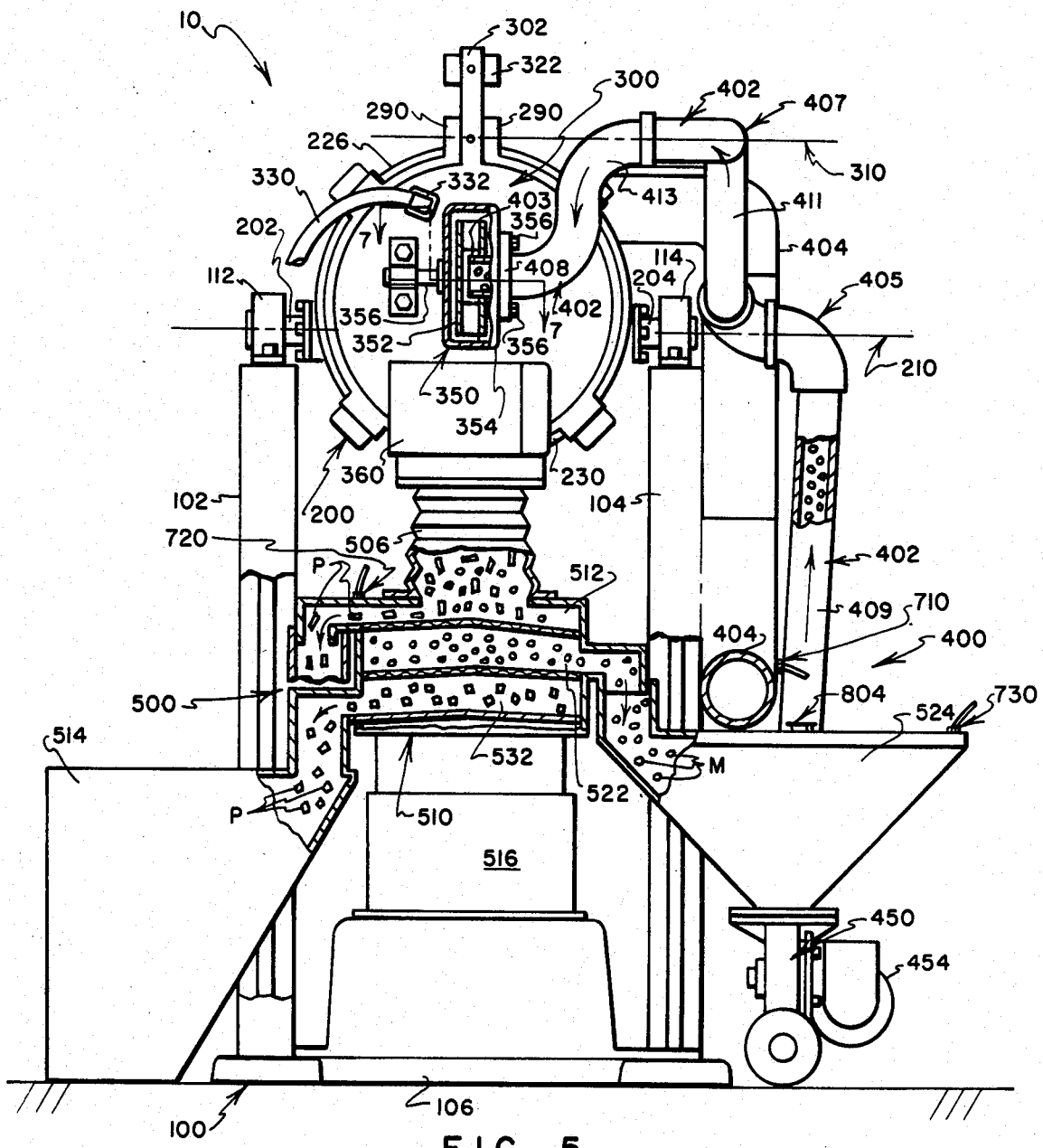
FIG. 5 is a front end elevational view of the machine with the machine's treatment receptacle oriented substantially horizontally, and with portions of the machine removed or broken away and shown in cross section.

The frame structure 100 includes a pair of upstanding A-frame members 102, 104 which are interconnected by a U-shaped base member 106. Bearing block assemblies 112, 114 are carried atop the A-frame members 102, 104. The receptacle assembly 200 has stub shafts 202, 204 which project from opposite sides thereof and are journalled by the bearing block assemblies 112, 114 to mount the receptacle assembly 200 for movement about a horizontal pivot axis which is indicated in FIG. 5 by the numeral 210.

Figure 2:
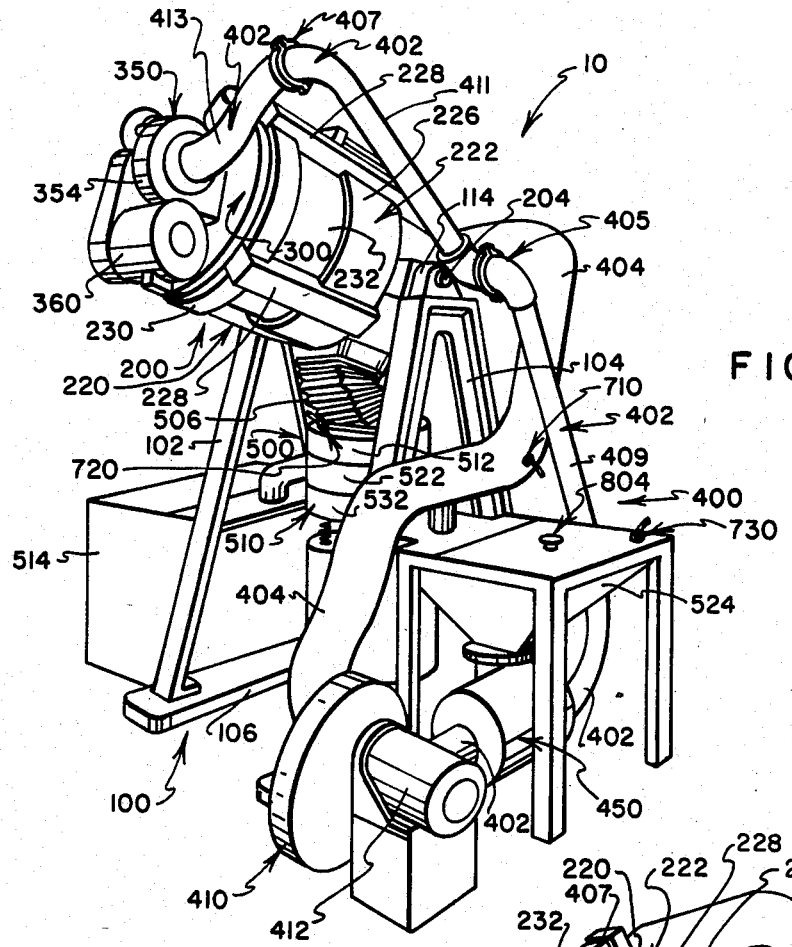
FIG. 2 is a perspective view similar to FIG. 1, but on a reduced scale and showing the door closed as it is during a deflashing operation.
Figure 3:
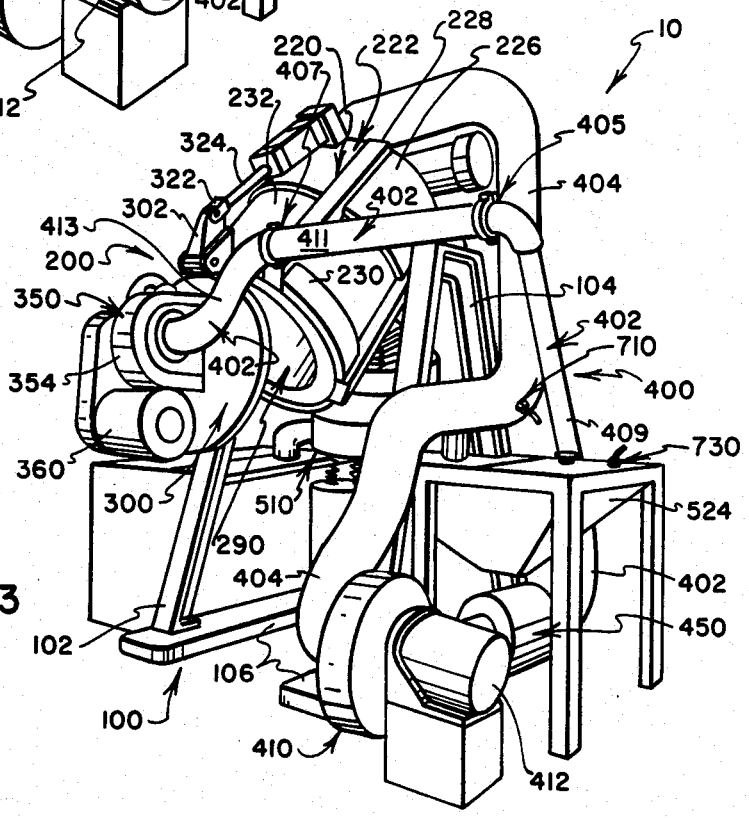
FIG. 3 is a perspective view similar to FIG. 2 but with the machine's treatment receptacle in a downwardly oriented position and with its door open for discharging deflashed workpieces.
Figure 4:
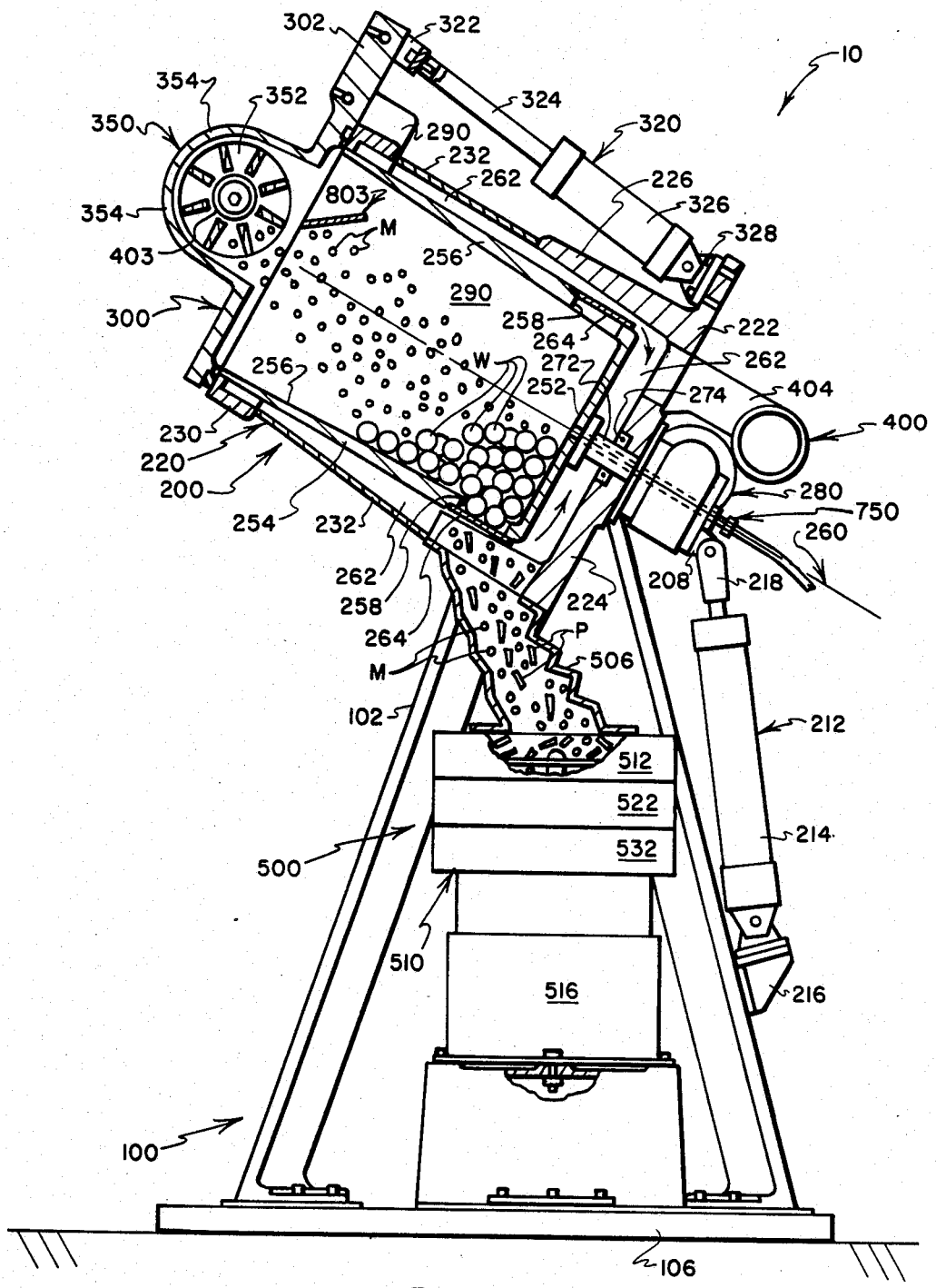
FIG. 4 is a side elevational view of the machine with its treatment receptacle oriented upwardly and with its door closed, and with portions of the machine removed or broken away and shown in cross section to illustrate operation of certain portions of the machine during a deflashing cycle.

As is best seen in FIG. 4, a pneumatic cylinder 212 is interposed between the frame structure 100 and the receptacle assembly 200 to pivot the receptacle assembly 200 about the pivot axis 210 (see FIG. 5 wherein the axis 210 is indicated by a center line, and FIG. 6 wherein the axis 210 is indicated by a point) between an upwardly oriented position, as shown in FIGS. 1, 2, 4 and 6, and a downwardly oriented position, as shown in FIG. 3. The cylinder 212 can also position the receptacle assembly 200 at intermediate positions, one of which is illustrated in FIG. 5. The cylinder 212 includes a body 214 which is pivotally connected to a bracket 216 that is secured to the A-frame member 102. The cylinder 212 has a ram 218 that is pivotally connected to a positioning arm 208 that is rigidly connected to the receptacle assembly 200.

The receptacle assembly 200 includes a housing structure 220 which forms part of an enclosure that enshrouds a drum 250. The drum 250 is rotatable about an axis 260 and defines a treatment chamber 290 within which workpieces to be deflashed may be positioned so that a deflashing operation can be carried out in a cryogenic environment which is established within the treatment chamber 290 as will be explained.

The housing structure 220 includes a base casting 222 which has a back wall 224 and a generally cylindrical side wall 226 that circumferentially surrounds a rearward end region of the drum 250. A plurality of cast arms 228 extend forwardly from the base casting 222 and support an annular front casting 230 that surrounds a forward open end region of the drum 250. A cylindrical shroud 232 bridges the spaces between the castings 222, 230 to complete the formation of an enclosure that surrounds side and rear wall portions of the drum 250 to define a closed compartment 262 about the drum 250, as is seen in FIG. 4.

Referring to FIG. 4, a stub shaft 272 and a bearing assembly 274 are carried respectively by the end wall 252 of the drum 250 and the back wall 224 of the housing structure 220, whereby the drum 250 is supported in a cantilevered fashion and is journaled for rotation about the axis 260. A variable speed drive motor assembly 280 is carried on the back wall 224 of the housing structure 220 and drivingly connects with the stub shaft 272 to rotate the drum 250 at selected speeds of rotation. If desired, the annular front casting 222 may be provided with an annular bearing (not shown) which surrounds the outer end region of the drum 250 and also assists in supporting the drum 250 for rotation about the axis 260.

The majority of the drum 250 is formed by a single casting 254 which defines the end wall 252 and a cylindrical side wall 256. Openings 258 are formed at spaced intervals through the side wall 256, and are covered by screens 264 for permitting particulates and cryogen gas to escape from the treatment chamber 290 into the closed compartment 262 which is defined about the drum 250. The wall structure which defines the openings 258 also serve the function of engaging workpieces in the drum 250 as the drum rotates, to help churn the workpieces about in the treatment chamber 290. As is seen in FIG. 4, workpieces W to be deflashed tend to congregate near the lower rear juncture of the side wall 256 and the end wall 252, and as one of the screened openings 258 passes by the congregation of workpieces W during rotation of the drum 250, some of the workpieces W are engaged by the drum structure surrounding the opening 258 and are caused to move with the rotating drum 250 to facilitate tumbling of the workpieces W.

Referring again to FIGS. 1–6, the receptacle assembly 200 also includes a door 300 for selectively opening and closing the open end of the drum 250 to selectively provide and preclude access to the treatment chamber 290. As is best seen in FIGS. 3, 4 and 5, the door 300 has an operating arm 302 which extends between and is pivotally connected to a pair of spaced upstanding ears 290. The ears 290 project upwardly from and are rigidly connected to the housing structure 220. A pneumatic cylinder 320 is carried atop the housing structure 220 and has a yoke 322 carried at the end of an extensible ram 324. The cylinder 320 has a body 326 which is connected to a bracket 328 that is rigidly secured to the base casting 222. The yoke 322 connects with the operating arm 302 of the door 300 for pivoting the door 300 about an axis 310 (see FIG. 5 wherein the axis 310 is indicated by a center line, and FIG. 6 wherein the axis 310 is indicated by a point) between an open position, as shown in FIGS. 1 and 3, and a closed position, as shown in FIGS. 2, 4, 5 and 6.

Figure 7:
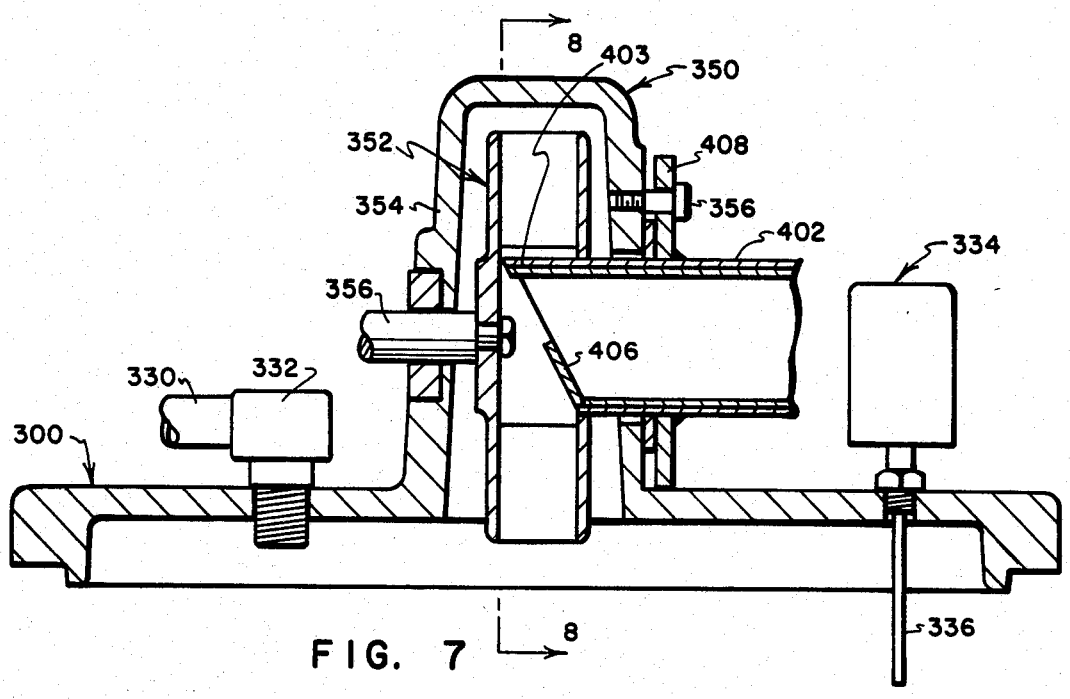
FIG. 7 is a sectional view, on an enlarged scale, as seen generally from planes indicated by a broken line 7—7 in FIG. 5.

Referring to FIGS. 5 and 7, a valved cryogen supply conduit 330 connects with a fitting 332 which is threaded through an opening provided in the door 300. The valved conduit 330 is connected to a source of pressurized cryogen (not shown) which is maintained at a temperature that is lower than such temperature as is desired to be maintained in the treatment chamber 290 during operation of the machine 10. The valved conduit 330 includes a conventional power-operated valve (not shown) for controlling the flow of cryogen into the treatment chamber 290 so that cryogen from the conduit 330 is added to the chamber 290 only when the temperature within the treatment chamber 290 is sensed as being higher than desired during a deflashing operation. As is also seen in FIG. 7, a transducer 334 is carried by the door 300 and has a portion 336 which projects into the treatment chamber 290 when the door 300 is closed to sense the temperature within the treatment chamber 290. The transducer 334 is commercially available from any of a number of manufacturers, and is selected to be of the type which will provide a signal that is representative of sensed temperature lying at least within a desired operating range of from about −250° F. to about −330° F. In preferred practice, what is depicted in the drawings as a transducer 334 is replaced by a commercially available thermocouple type of transducer (not shown) that is selected to be of the type which will provide a signal that is representative of sensed temperature lying within the machine's operating range of temperatures.

A throwing wheel assembly 350 is carried on the door structure 300. As is best seen in FIGS. 4, 5, 7 and 8, the throwing wheel assembly 350 includes a vaned rotor 352 which is enclosed by a surrounding housing 354. A shaft 356 supports the rotor 352 for rotation, and is journaled by bearings (not shown) carried on the door 300. A variable speed motor 360 is carried on the door 300 and is drivingly connected to the shaft 356 for rotating the vaned rotor 352 at controlled speeds of operation.

Figure 8:
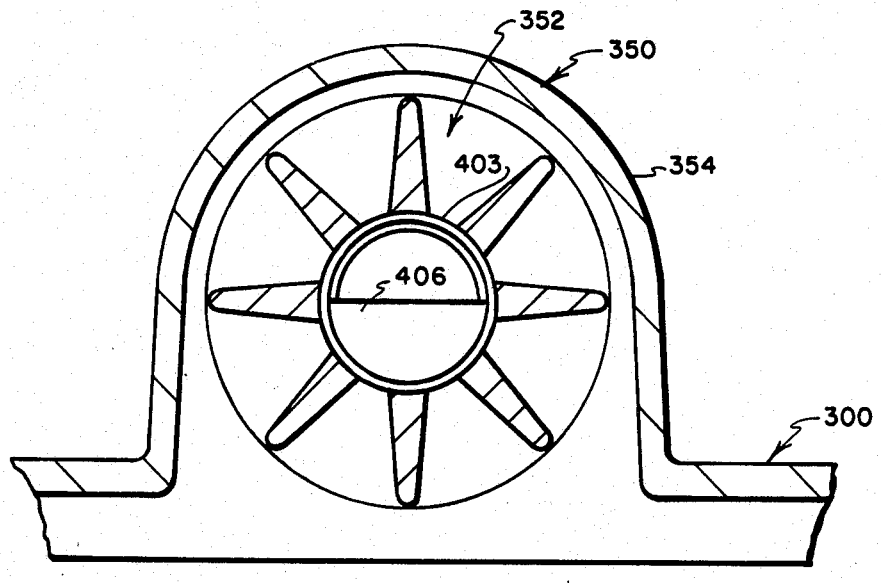
FIG. 8 is a sectional view as seen generally from a plane indicated by a line 8—8 in FIG. 7.

Referring to FIGS. 5, 7 and 8, a supply conduit 402 has an end formation 403 which extends into the housing 354 to introduce a flow of cryogen gas and particulate media into a center region of the vaned rotor 352. Media and cryogen introduced through the conduit end formation 403 are caused to be projected outwardly under centrifugal force as the rotor 352 is turned by the motor 360. Thus, the throwing wheel 350 operates to direct a flow of particulate media and cryogen gas from the supply conduit 402 into the drum 250 for impacting contents of the treatment chamber 290.

Referring to FIGS. 1–3, 5 and 6, the supply conduit 402 includes a pair of pivotal joint assemblies 405, 407. The joint assembly 405 pivotally interconnects lower and intermediate supply conduit sections 409, 411 for relative movement about the axis 210 (see FIG. 5 wherein the axis 210 is indicated by a center line, and FIG. 6, wherein the axis 210 is indicated by a point). The joint assembly 407 pivotally interconnects the intermediate conduit section 413 for relative movement about the axis 310 (see FIG. 5 wherein the axis 310 is indicated by a center line, and FIG. 6 wherein the axis 310 is indicated by a point). By this arrangement, the conduit sections 409, 411 are able to move concurrently with their associated relatively movable machine components, namely the frame structure 100 and the receptacle assembly 200, as these components pivot relatively about the axis 210. Similarly, the conduit sections 411, 413 are able to move concurrently with their associated relatively movable machine components, namely the housing structure 220 and the door 300, as these components pivot relatively about the axis 310.

The joint assemblies 405, 407 are formed from identical components. Referring to FIG. 9 wherein components of the joint assembly 405 are depicted, the associated supply conduit sections 409, 411 have aligned portions which extend along the pivot axis 210, and carry end flanges 419, 421, respectively. A resilient annular seal 415 is interposed between opposed faces 423, 425 of the flanges 419, 421, respectively, to establish a fluid-tight seal therebetween which will permit relative movement of the conduit sections 409, 411 about the axis 210. The seal 415 is preferably formed from a high molecular weight polyethylene which will remain resilient in the presence of ambient air temperatures as well as cryogenic temperatures. A pair of clamping U-shaped brackets 431 are provided for surrounding the flanges 419, 421 and the seal 415 to hold these components in alignment while permitting their relative movement about the axis 210. Threaded fasteners 427 extend through aligned holes 433 provided in end portions 435 of the brackets 431 and are secured by nuts 429 to clamp the end portions of the brackets 431 together. U-shaped grooves 439 are provided in curved portions 437 of the brackets 431 to surround and engage the flanges 419, 421 with the seal 415 clamped therebetween. The width of the grooves 439 are formed such that the brackets 431 serve to maintain the flanges 419, 421 in clamping engagement with the seal 415.

Referring to FIGS. 1–6, the recirculation system 400 includes not only the supply conduit 402 but also a withdrawal conduit 404 for evacuating cryogen gas from an upper portion of the rear part of the receptacle assembly 200, and a blower 410 for receiving cryogen gas from the withdrawal conduit 404 and delivering repressurized cryogen gas to the supply conduit 402. In most preferred practice the conduit 402 includes a flexible bellows section 801 (depicted schematically in FIG. 1) to aid the conduit 402 in extending and contracting in length as may be needed to accommodate relative movements of the various machine components as has been described. A variable speed drive motor 412 (or other suitable type of commercially available drive motor) is provided for driving the blower 410. The blower 410 operates in a push-pull fashion to establish a high velocity flow of cryogen gas through the treatment chamber by (1) diminishing pressure within the withdrawal conduit 404 to effectively evacuate gas from the receptacle assembly 200, and (2) by repressurizing the cryogen gas for delivery under pressure to the receptacle assembly 200 through the supply conduit 402 and the throwing wheel 350. A metering valve 450 (best illustrated in FIG. 6) is interposed in the supply conduit 402 for introducing a controlled flow of particulate media into the flow of pressurized cryogen which is being delivered through the supply conduit 402 to the throwing wheel 350. The metering valve 450 includes a vaned rotor 452 which is driven by a variable speed drive motor 454 (seen in FIG. 5) for dispensing a controlled flow of particulate media M into the supply conduit 402. In most preferred practice, a pipe 802 extends through the supply of media M in the hopper 524, such that its upper end region extends above the supply of media M in the hopper 524, and its lower end extends into the vicinity of the valve 450 to vent pressurized gas from the valve 450 into the hopper 524 so that the flow of media M into the valve 450 from the hopper 524 will proceed smoothly.

The recirculation system 400 also includes a separation system 500 for withdrawing particulates including particles of flash P and particulate media M from the receptacle assembly 200, and for ducting these particles to a three-stage separator unit 510. A flexible, accordion-folded bellows 506 is provided for ducting particulates from the compartment 262 into the separator unit 510. The bellows is preferably formed from an aluminized glass fiber material or other suitable material which will remain flexible and extensible in the manner of an accordion in the presence of ambient air temperatures as well as cryogenic temperatures.

As is best seen in FIG. 5, the separator unit 510 has a first or upper stage 512 which effectively removes large particles of flash P for delivery to a waste bin 514, a second or middle stage 522 which effectively withdraws reusable particulate media M for delivery to a hopper 524, and a third or lower stage 532 which ducts smaller particles P of flash and other waste particulates into the waste bin 514. A conventional vibratory drive system 516 is provided for effecting vibratory separation of the particulates P and M within the unit stages 512, 522, 532.

Figure 6:
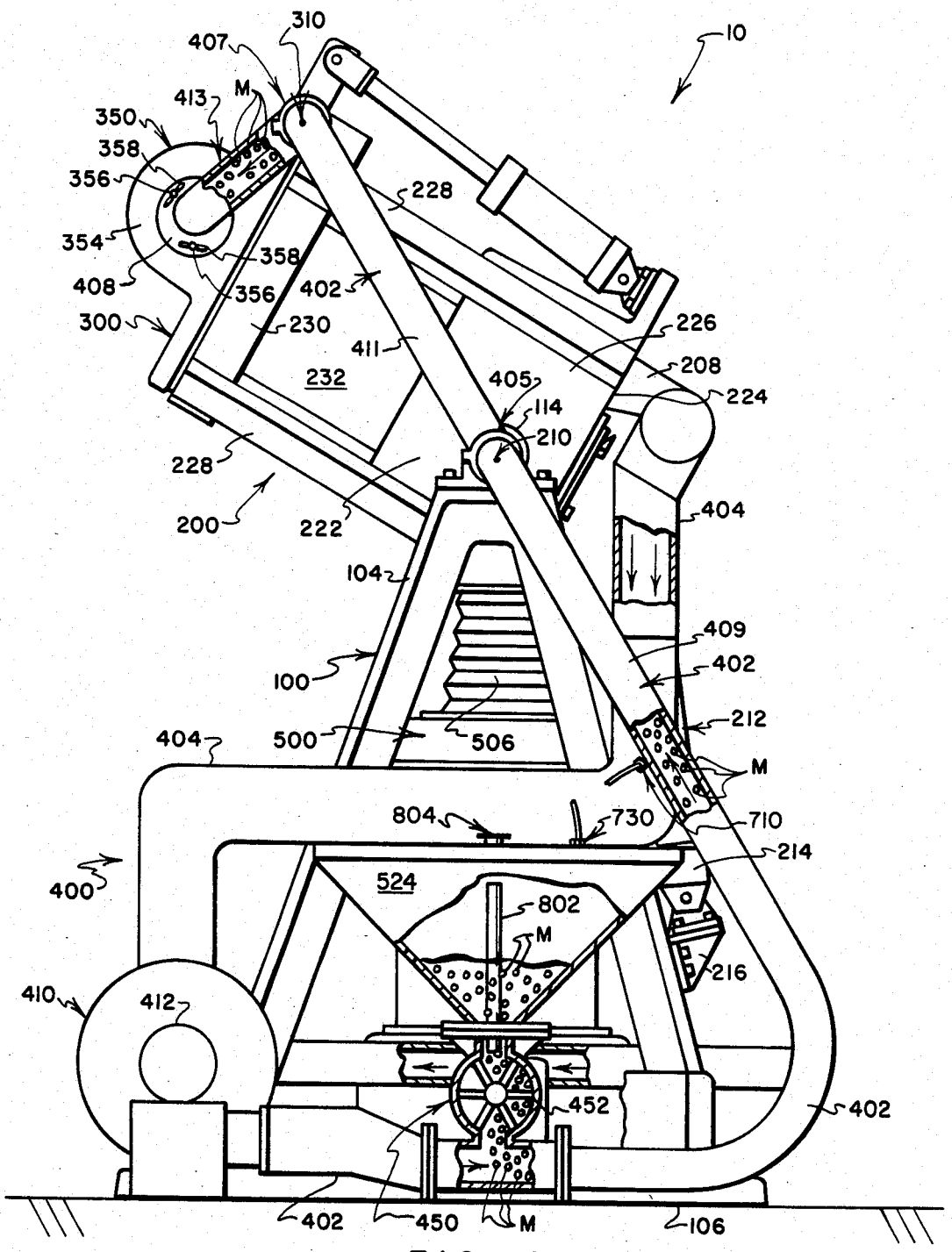
FIG. 6 is a side elevational view similar to FIG. 4 but with fewer portions of the machine removed or broken away and show in in cross section.

Referring to FIGS. 7 and 8, the supply conduit end formation 403 is tapered and is partially covered by a semi-circular shroud plate 406. Referring to FIG. 6, an annular plate 408 is welded about the periphery of the supply conduit 402 and is secured to the throwing wheel housing 354 by threaded fasteners 356. Slots 358 are formed in the annular plate 408 to enable the plate 408 to be rotated relative to the housing 354 so that the orientation of the tapered end formation 403 with respect to the housing 354 can be adjusted. This adjustment is effected by loosening the threaded fasteners 356, by rotating the annular plate 408 to reorient the tapered inner end formation 403 as desired, and by tightening the threaded fasteners 356 to secure the end formation 403 with respect to the housing 354. The purpose of adjusting the orientation of the tapered inner end formation 403 is to provide a degree of control with respect to the direction and manner in which particulate media is discharged from the throwing wheel 350 into the drum 250. The direction of discharge of media particles which are propelled by the throwing wheel 350 can, in this manner, be adjusted to aim these particles toward an upper wall portion of the drum 250, a lower wall portion of the drum 250, or in directions extending more closely along the central rotation axis 260. In most preferred practice, a deflector plate 803 is adjustably carried by the door 300 for assisting in guiding the directional discharge of media M into the treatment chamber 290, as is depicted in FIG. 4.

In operation, the apparatus 10 is preferably put through an initialization procedure to ready it to receive a first charge of workpieces W to be deflashed if the apparatus 10 is being put into operation after having been shut down for any significant period of time. The initialization procedure is carried out by positioning the receptacle assembly 200 in its upwardly oriented position with the door 300 closed, as is shown in FIG. 2. Cryogen is introduced into the treatment chamber 290 through the valved conduit 330, and operation of the blower 410 is initiated to circulate cryogen throughout the closed system of the machine 10 and to purge the machine 10 of air and moisture, whereby the components of the machine 10 are prechilled and are thereby readied for a deflashing operation.

An actual deflashing operation is carried out by positioning the receptacle assembly 200 in its upwardly oriented position with the door 300 open, as is shown in FIG. 1, whereupon a charge of workpieces W to be deflashed is positioned in the treatment chamber 290. The door 300 is then closed, and system operation is begun. As is depicted schematically in FIGS. 4 and 5, during system operation a flow of cryogen gas and particulate media is delivered through the supply conduit 402 to the throwing wheel 350. The throwing wheel 350 projects a relatively high velocity flow of cryogen gas and media M into the treatment chamber 290 to impact workpieces W as the drum 250 is rotated to impart a tumbling action to the workpieces so that all flash-carrying surfaces of the workpieces W are exposed to the embrittling affect of the cryogen and the impact of the media particles M.

During rotation of the drum 250, a flow of particulates discharges from the treatment chamber 290 through the screened openings 258 into the compartment 262, and through the flexible conduit 506 into the separator assembly 510. At the same time, cryogen gas discharges from the treatment chamber 290 through the screened openings 258 into the compartment 262, and is ducted by the withdrawal conduit 402 to the blower 410. The blower 410 repressurizes the withdrawn cryogen gas and ducts it into the supply conduit 402 through which it travels at relatively high velocity back to the throwing wheel 350. The separator assembly 510 segregates reusable particulate media M and ducts it into the containment hopper 524, from where the media M flows under the influence of gravity and as controlled by the metering device 450 into the supply conduit 402 for return to the throwing wheel 350. Waste particulates including pieces of flash P and the like are ducted by the separator assembly 510 into the waste bin 514.

A feature of the described system lies in its capability during system design to be scaled upwardly or downwardly in size to provide apparatus of a desired capacity. In this regard, a drum 250 having an internal capacity of about 3 cubic feet is found to work well in deflashing a volume of about 1 cubic foot of workpieces.

In order to carry out a deflashing operation with maximum efficiency, such operating parameters as (1) the orientation of the axis of rotation of the drum 250 (normally oriented horizontally or tilted upwardly to within a range of about 0° to 30° [preferably about 18°] from the horizontal), (2) the temperature within the receptacle assembly 200 (normally within the range of about +20° F. and −280° F.), (3) the speed of rotation of the drum 250 (normally within the range of about 0–60 rpm), (4) the speed of rotation of the throwing wheel 350 (normally within the range of about 1,000–10,000 rpm), (5) the speed of rotation of the blower 410 (preferably at about 3450 rpm), (6) the shape, size and type of the particulate media M (normally polycarbonate particles of a selected uniform size), (7) the pattern of projection of particulate media M which is introduced into the treatment chamber 290, and the like, are preferably preset to correspond with optimum settings that have been predetermined through experimentation as being optimum for the particular workpieces to be deflashed. To the degree that these parameters are adjustable by operator controls, suitable commercially available control devices (not shown) are preferably provided to facilitate the setting and determination of appropriate parameters.

Once a deflashing operation has been completed, the flow of cryogen and particulate media through the system of the machine 10 is stopped by cutting off flow through the supply line 330, and by stopping the blower 410. The receptacle assembly 200 is tilted to its downwardly oriented position, and the door 300 is opened, as is shown in FIG. 3, whereupon the deflashed workpieces are discharged from the treatment chamber 290 into an awaiting receptacle (not shown). In preferred practice, the door 300 is kept open for as short a time as possible to minimize the escape of cryogen from the system of the machine 10 and to minimize the entry of ambient moisture into the system of the machine 10.

In order to purge the system of the apparatus 10 of moisture laden ambient air, and in order to maintain a positive pressure inert atmosphere throughout the apparatus 10 to inhibit entry of moisture laden ambient air, the apparatus 10 includes a purging system connected to a pressurized supply of an inert gas such as nitrogen (not shown). In preferred practice, the type of purging system utilized in order to exclude ambient air from the closed recirculation system of the apparatus 10 actually amounts to two separate purging systems, one operating at a relatively low pressure and employing a plurality of system inlets for ducting nitrogen gas into the apparatus 10, and the other being a relatively higher pressure system employing a single inlet for ducting a higher pressure flow of nitrogen into the treatment chamber 290 when the door 300 is open.

Referring to FIGS. 1–3, 5 and 6, three inlets of a relatively low pressure purging system are indicated generally by the numeral 710, 720, 730. Referring to FIG. 4, a single inlet of a relatively high pressure purging system is indicated generally by the numeral 750. The inlets 710, 720 and 730 comprise hose end fittings and hoses that extend from a suitable conventional source of pressurized nitrogen (not shown) and communicate, respectively, (1) with the withdrawal conduit 404 at a location about midway along its length between its upper end that connects with the receptacle assembly 200, and its lower end that connects with the blower 410;, (2) with the first or upper stage 512 of the separator unit 510 at a location near where the bellows 506 connects with the separator system 500; and (3) with the media hopper 524 at a location along the upper surface thereof. The relatively low pressure inlets 710, 720, 730 preferably operate at a pressure that is about five pound per square inch above the pressure of ambient air, and cooperate to maintain a positive pressure inert gas atmosphere throughout the closed recirculation system of the apparatus 10.

The higher pressure treatment chamber inlet 750 includes a hose end fitting and a hose that extends from a suitable conventional source of pressurized nitrogen (not shown) and communicates with the treatment chamber 290 through a hole that extends centrally along the axis of the shaft 272 that mounts the drum 250 for rotation. The inlet 750 is utilized only when the door 300 is open, and serves to inject a flow of nitrogen at a pressure of about ten pounds per square inch above the pressure of ambient air, into the treatment chamber 290 to minimize entry into the treatment chamber 290 of ambient air when the treatment chamber door 300 is open. In most preferred practice, a pressure relief valve 804 is carried by the top wall of the hopper 524 for relieving any pressure buildup within the hopper that exceeds about five pounds per square inch above atmosphere pressure.

The above-described locations of the inlets 710, 720, 730, and 750 have been found, through experimentation to provide exactly the desired type of highly effective purging action that is needed in order to permit ambient air to be purged from the system of the apparatus 10 during startup of the apparatus (i.e., at a time before the flow of cryogen into the treatment chamber 290 is begun), and that will serve to properly maintain a positive pressure inert gas atmosphere within the closed system of the apparatus 10 to exclude ambient air during and following system operation. While larger numbers of purging gas inlets could be utilized, and while other inlet locations can be employed, the described positioning of the inlets 710, 720, 730 and 750 has been formed through experimentation to perform as desired and in a most preferred manner. Through experimentation it has been learned that there ordinarily is no need to provide a purge gas inlet specifically for the supply conduit 402 inasmuch as the supply conduit 402 is normally pressurized by the blower 410 during operation of the machine, and inasmuch as purge gas will enter the supply conduit 402 from the other described inlets 710, 720 and 730 when the machine 10 is not performing a deflashing function but is being purged of ambient air.

After deflashing procedures have been completed, the flow of nitrogen gas into the closed system of the apparatus 10 through the inlets 710, 720, 730 is preferably maintained until components of the system have returned to temperatures wherein entry of moisture laden ambient air into the system of the apparatus 10 will not cause damage or deterioration through the condensation of moisture and/or the formation of ice.

As will be apparent from the foregoing description, the system of the present invention has novel and improved features that include advances in both method and apparatus. The system includes a significant number of simplifications and a more efficient arrangement and utilization of components as compared with prior proposals. In operational tests, the system has been found to carry out deflashing procedures expeditiously and reliably with a wide variety of workpieces to be deflashed.

Although the invention has been described in its preferred form with a certain degree of particularity, it will be understood that the present disclosure of the preferred form has been made only by way of example, and that numerous changes in the details of construction and the combination and arrangements of parts and the like may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A cryogen shot blast deflashing apparatus, comprising:

(a) receptacle means defining a treatment chamber for receiving workpieces to be deflashed, frame means for supporting the receptacle means for movement relative to the frame means, and drive means for moving the receptacle means relative to the frame means to impart movement to workpieces contained within the treatment chamber;

(b) throwing wheel means for receiving a supply of particulate media and a flow of cryogen gas, for propelling media into the treatment chamber to impact workpieces which are being moved about within the treatment chamber, and for introducing a relatively high velocity flow of cryogen gas into the treatment chamber;

(c) cryogen recirculation means for withdrawing cryogen gas from the treatment chamber and for redelivering cryogen gas to the throwing wheel, the cryogen recirculation means including a blower for assisting in the withdrawal of cryogen gas from the treatment chamber and for pressurizing the withdrawn cryogen gas for return to the treatment chamber through the throwing wheel, whereby the blower and the throwing wheel means cooperate to establish a high velocity flow of cryogen gas through the treatment chamber to establish a high convection heat transfer which facilitates rapid embrittlement of workpiece flash;

(d) the receptacle means, the throwing wheel means and the cryogen recirculation means cooperating to define a closed recirculation system; and, (e) purging means for introducing a plurality of flows of purging gas into the closed recirculation system at a plurality of spaced locations to maintain a positive pressure atmosphere within the closed recirculation system to prevent entry into the closed recirculation system of moisture containing ambient air, and to thereby minimize the condensation of moisture and the formation of ice within the closed recirculation system.

2. The deflashing apparatus of claim 1 wherein the closed recirculation system includes media supply means defining a path of flow for introducing a metered flow of particulate media into the pressurized flow of cryogen gas being delivered to the throwing wheel means, and the purging means includes inlet means for introducing a flow of said purging gas along said path of flow into the media supply means to maintain a positive pressure atmosphere within the media supply means.

3. The deflashing apparatus of claim 1 wherein the closed recirculation system includes particulate media recirculation means defining a path of flow for withdrawing reusable media from the treatment chamber and for introducing a metered flow of such withdrawn media into the pressurized flow of cryogen gas being delivered to the throwing wheel means, and wherein the purging means includes inlet means for introducing a flow of said purging gas along said path of flow into the media recirculation means to maintain a positive pressure atmosphere within the media recirculation means.

4. The deflashing apparatus of claim 1 wherein:

(a) the closed recirculation system includes containment means for containing a supply of particulate media and media supply means defining a path of flow for delivering media from the media supply means into the pressurized flow of cryogen being delivered to the throwing wheel means; and, (b) the purging means includes inlet means connected to the containment means and to the media supply means for introducing a flow of said purging gas into the containment means to maintain a positive pressure atmosphere within the containment means.

5. The deflashing apparatus of claim 4 wherein the closed recirculation system additionally includes media recirculation means defining a passage for receiving a flow of particulates which are withdrawn from the treatment chamber, for segregating reusable particulate media from such flow, and for delivering segregated media into the containment means, and the purging means includes inlet means for introducing a flow of said purging gas into said passage to maintain a positive pressure atmosphere within the media recirculation means.

6. The deflashing apparatus of claim 1 wherein:

(a) the cryogen recirculation means includes withdrawal conduit means for withdrawing cryogen gas from the treatment chamber, and supply conduit means for redelivering pressurized cryogen to the throwing wheel means;

(b) the blower is connected to the withdrawal conduit means and to the supply conduit means for evacuating cryogen gas from the treatment chamber through the withdrawal conduit means, for pressurizing such withdrawn cryogen gas, and for delivering pressurized cryogen gas to the throwing wheel means through the supply conduit means; and, (c) the purging system includes inlet means for delivering separate flows of said purging gas into the treatment chamber, and into the withdrawal conduit means to maintain a positive pressure atmosphere therein.

7. The deflashing apparatus of claim 1 wherein the purging system additionally includes sensing and control means for monitoring the open and closed positions of the door and for operating at least a portion of the purging system in response to the sensed positions of the door to maintain a positive pressure flow of said purging gas into the treatment chamber when the door is open, and to maintain a positive pressure atmosphere in the treatment chamber when the door is closed.

8. The deflashing apparatus of claim 1 wherein the purging system additionally includes pressure relief means for relieving a pressure buildup within the closed recirculation system that exceeds a predetermined pressure level.

9. A cryogen deflashing apparatus comprising:

(a) tumbling means including a frame structure rotatably supporting a drum-like container defining a treatment chamber for rotation about an axis to impart a tumbling action to contents of the treatment chamber;

(b) throwing wheel means for receiving a supply of particulate media and for propelling the media into the treatment chamber to impact contents of the treatment chamber while the contents are being tumbled about by rotation of the container during operation of the apparatus;

(c) cryogen supply means for introducing a flow of cryogen into the treatment chamber for embrittling at least selected portions of the contents of the treatment chamber;

(d) cryogen recirculation means for withdrawing cryogen gas from the treatment chamber and for redelivering cryogen gas to the treatment chamber through the throwing wheel means during operation of the apparatus;

(e) media supply means for introducing a metered flow of particulate media into the pressurized flow of cryogen gas which is delivered to the throwing wheel means during operation of the apparatus;

(f) the receptacle means, the throwing wheel means and the cryogen recirculation means cooperating to define a closed recirculation system; and, (e) purging means for introducing a plurality of flows of purging gas into the closed recirculation system at a plurality of spaced locations to maintain a positive pressure atmosphere within the closed recirculation system to prevent entry of moisture containing ambient air, and to minimize the condensation of moisture and the formation of ice in the closed recirculation system.

10. The deflashing apparatus of claim 9 wherein the media supply means includes separator means for receiving a flow of particulates which is withdrawn from the treatment chamber, for segregating reusable particulate media from such flow, and for delivering segregated particulate media into a containment means, and the purging means includes inlet means for introducing a flow of said purging gas into the media supply means to maintain a positive pressure atmosphere therein.

11. The deflashing apparatus of claim 10 wherein the containment means includes a hopper into which segregated particulate media from the separator means together with an additional quantity of particulate media may be contained for use in deflashing operations, and the purging means includes additional inlet means connected to the containment means for introducing a flow of said purging gas into the containment means to maintain a positive pressure atmosphere therein.

12. The deflashing apparatus of claim 9 wherein the media supply means includes particulate media recirculation means defining a path of flow for withdrawing reusable particulate media from the treatment chamber and for introducing such withdrawn particulate media into the pressurized flow of cryogen gas for return therewith through the throwing wheel to the treatment chamber, and wherein the purging means includes inlet means for introducing gas along the path of flow to maintain a positive pressure atmosphere in the media recirculation means.

13. The deflashing apparatus of claim 9 wherein:

(a) the media supply means additionally includes containment means for containing a supply of particulate media; and, (b) the purging means includes inlet means connected to the containment means for introducing a flow of said purging gas into the containment means to maintain a positive pressure atmosphere therein.

14. The deflashing apparatus of claim 13 additionally including media recirculation means defining a path of flow for receiving a flow of particulates which are withdrawn from the treatment chamber, for segregating reusable particulate media from such flow, and for delivering segregated media into the containment means, and the purging means includes inlet means for introducing said purging gas along the path of flow into the media recirculation means to maintain a positive pressure atmosphere therein.

15. The deflashing apparatus of claim 9 wherein:

(a) the cryogen recirculation means includes withdrawal conduit means for withdrawing cryogen gas from the treatment chamber, and supply conduit means for redelivering pressurized cryogen to the throwing wheel means;

(b) the blower is connected to the withdrawal conduit means and to the supply conduit means for evacuating cryogen gas from the treatment chamber through the withdrawal conduit means, for pressurizing such withdrawn cryogen gas, and for delivering pressurized cryogen gas to the throwing wheel means through the supply conduit means; and, (c) the purging means includes inlet means for ducting said purging gas into the treatment chamber and into the withdrawal conduit means to maintain positive pressure atmospheres therein.

16. The deflashing apparatus of claim 9 wherein the purging means additionally includes sensing and control means for monitoring the open and closed positions of the door and for operating at least a portion of the purging means in response to the sensed positions of the door to maintain a positive pressure flow of said purging gas into the treatment chamber when the door is open and to maintain positive pressure atmosphere in the treatment chamber when the door is closed.

17. The deflashing apparatus of claim 9 wherein the purging system additionally includes pressure relief means for relieving a pressure buildup within the closed recirculation system that exceeds a predetermined pressure level.

18. A cryogen shot blast deflashing apparatus, comprising:

(a) a supporting frame including a pair of upstanding leg structures which are spaced apart one from the other, with each of the leg structures carrying a separate bearing structure near its upper end, and with the bearing structures cooperating to define a first, substantially horizontally-extending pivot axis;

(b) a receptacle assembly including a rotatable drum, housing means for surrounding at least portions of the rotatable drum and cooperating therewith for defining a closed treatment chamber within which workpieces to be deflashed can be positioned and tumbled about during a deflashing process, the receptacle assembly having a pair of stub shafts extending from opposite sides thereof and being received within the bearing means of the frame structure to support the receptacle assembly for pivotal movement relative to the frame structure about the first pivot axis;

(c) throwing wheel means carried by the receptacle assembly for introducing a flow of particulate media and cryogen gas into the treatment chamber defined by the rotating drum;

(d) cryogen recirculation means connected to the receptacle assembly and to the throwing wheel means for withdrawing cryogen gas and particulates from the treatment chamber, for separating reusable particulate media from other withdrawn particulate such as pieces of workpiece flash, and for returning a flow of cryogen gas and particulate media to the throwing wheel for reintroduction into the treatment chamber through a common supply conduit which communicates with the throwing wheel means;

(e) the receptacle assembly, the throwing wheel means and the cryogen recirculation means cooperating to define a closed recirculation system; and, (f) purging means for introducing flows of purging gas into the closed recirculation system at a plurality of locations to maintain a positive pressure atmosphere therein to prevent entry of moisture containing ambient air, and to thereby minimize the condensation of moisture and the formation of ice in the closed recirculation system.

19. The deflashing apparatus of claim 18 wherein:

(a) the cryogen recirculation means includes:

(i) vibratory separator means connected to the receptacle means for receiving a flow of particulates from the treatment chamber and for separating reusable particulate media from other particulates such as pieces of workpiece flash;

(ii) containment means for receiving separated reusable particulate media from the separator means; and, (iii) metering means for introducing a controlled flow of particulate media from the containment means into the supply conduit for delivery together with a flow of cryogen to the throwing wheel means; and, (b) the purging means includes inlet means for introducing said purging gas into the vibratory separator means and the containment means to maintain positive pressure atmospheres within the separator means and the containment means.

20. The deflashing apparatus of claim 18 wherein the purging means additionally includes sensing and control means for monitoring the open and closed positions of the door and for operating at least a portion of the purging means in response to the sensed positions of the door to maintain a positive pressure flow of said purging gas into the treatment chamber when the door is open, and to maintain a positive pressure atmosphere in the treatment chamber when the door is closed.

21. A cryogen shot blast deflashing apparatus, comprising:

(a) an upstanding frame;

(b) a receptacle assembly supported by the upstanding frame;

(c) the receptacle assembly including container means which defines a treatment chamber for receiving workpieces, which has an access opening for enabling workpieces to be charged into and discharged from the treatment chamber, and which is mounted for movement relative to the upstanding frame;

(d) container drive means for moving the container means relative to the frame to impart movement to workpieces which have been charged into the treatment chamber;

(e) the receptacle assembly additionally including a housing enshrouding at least portions of the container means and having closure means mounted for movement between positions wherein the closure means selectively opens and closes the access opening of the container means;

(f) throwing wheel means carried by the receptacle assembly for projecting particulate media into the treatment chamber for impacting workpieces contained therein;

(g) containment means for containing a supply of particulate media;

(h) cryogen recirculation means including withdrawal conduit means connected to the receptacle assembly for withdrawing cryogen gas from the treatment chamber, supply conduit means connected to the throwing wheel means for delivering cryogen under pressure to the throwing wheel means, and blower means connected to the withdrawal conduit means and to the supply conduit means for evacuating cryogen gas from the treatment chamber through the withdrawal conduit means, for pressurizing such withdrawn cryogen gas, and for delivering such pressurized cryogen gas to the throwing wheel means through the supply conduit means;

(i) metering means connected to the supply conduit means and to the containment means for introducing a metered flow of particulate media from the containment means into the pressurized flow of cryogen being delivered through the supply conduit means to the throwing wheel means; and, (j) the receptacle assembly, the throwing wheel means, the containment means and the cryogen recirculation means, and the metering means cooperating to define a closed recirculation system; and, (k) purging means for introducing a plurality of separate purging flows of gas into the closed recirculation system at a plurality of locations to maintain a positive pressure atmosphere therein to prevent entry of moisture containing ambient air, and to minimize the condensation of moisture and the formation of ice in the closed recirculation system.

22. The deflashing apparatus of claim 21 wherein the closed recirculation system additionally includes separator means for receiving a flow of particulate materials which is withdrawn from the treatment chamber, for segregating reusable particulate media from such flow, and for delivering such segregated particulate media into the containment means, and the purging means includes inlet means for introducing a flow of said purging gas into the separator means to maintain a positive pressure atmosphere in the separator means.

23. The deflashing apparatus of claim 22 wherein the containment means includes a hopper into which segregated particulate media from the separator means together with an additional quantity of particulate media may be contained for use in deflashing operations, and the purging means includes inlet means for introducing a flow of said purging gas into the hopper to maintain a positive pressure atmosphere in the hopper.

24. The deflashing apparatus of claim 23 wherein:

(a) the drum has a substantially cylindrical outer wall which extends from an inner end to an outer end, with the inner end having an end wall that closes one end of the drum, and with the outer end defining the access opening;

(b) the axis of rotation of the drum extends:

(i) substantially coaxially with respect to the cylindrical outer wall of the drum;

(ii) substantially centrally through the inner end wall; and, (iii) through the access opening defined by the outer end of the drum; and, (c) the purging means includes inlet means extending along the axis of rotation of the drum for introducing a flow of said purging gas into the drum.

25. The deflashing apparatus of claim 24 wherein the purging means additionally includes sensing and control means for monitoring the open and closed positions of the door and for operating at least a portion of the purging means in response to the sensed positions of the door to maintain a positive pressure flow of said purging gas into the treatment chamber when the door is open, and to maintain a positive pressure atmosphere in the treatment chamber when the door is closed.

26. A method of operating a deflashing apparatus to deflash workpieces formed from relatively flexible material, comprising the steps of:

(a) positioning workpieces to be deflashed in a treatment chamber defined by a receptacle of a deflashing apparatus, and moving the receptacle to impart movement to such workpieces as are positioned within the treatment chamber;

(b) establishing a flow of cryogen gas and particulate media through the treatment chamber with the cryogen gas being brought into engagement with the workpieces for embrittling workpiece flash, and with the particulate media being caused to impact the workpieces to remove embrittled flash therefrom;

(c) withdrawing cryogen gas from the treatment chamber, repressurizing the withdrawn cryogen gas, ducting the repressurized cryogen gas into a supply conduit for return to the treatment chamber, and introducing the repressurized cryogen gas into the treatment chamber through a throwing wheel;

(d) introducing a metered flow of particulate media into the flow of pressurized cryogen gas being ducted through the supply conduit for projection into the treatment chamber through the throwing wheel together with the flow of pressurized cryogen gas; and, (e) maintaining a positive pressure atmosphere within the closed recirculation system by introducing a plurality of flows of purging gas into the recirculation system to prevent entry into the closed recirculation system of moisture laden ambient air.

27. The method of claim 26 additionally including the step of withdrawing a flow of particulates along a path of travel from the treatment chamber during the time while a flow of cryogen gas and particulate media is being introduced into the treatment chamber, segregating reusable particulate media from the withdrawn flow of particulates during movement along the travel path, and introducing said purging gas along the travel path to maintain a positive pressure atmosphere along the travel path.

28. The method of claim 26 wherein the step of introducing purging gas includes the step of initiating and maintaining said flows of purging gas into the recirculation system prior to the steps of establishing a flow of cryogen gas and particulate media, whereby ambient air is purged from the recirculation system.

29. The method of claim 26 wherein the step of introducing purging gas includes the step of maintaining said flows of purging gas for a period of time after the deflashing of workpieces has been completed and the flow of cryogen gas has been terminated, whereby ambient air is prevented from entering the recirculation system during said period of time.

30. A method of deflashing workpieces formed from relatively flexible material, comprising the steps of:

(a) providing deflashing apparatus which includes
  (i) an upstanding frame;
  (ii) a receptacle supported on the frame and carrying a rotatable container which defines a treatment chamber and has an access opening for charging workpieces into and discharging workpieces from the treatment chamber;
  (iii) closure means for selectively opening and closing the access opening; and,
  (iv) throwing wheel means for projecting particulate media into the treatment chamber for impacting workpieces contained in the treatment chamber;

(b) opening the access opening by moving the closure to an open position;

(c) charging the treatment chamber with workpieces to be deflashed;

(d) closing the access opening by moving the closure means to a closed position;

(e) rotating the container about an axis of rotation to effect a tumbling of such workpieces as have been charged into the treatment chamber;

(f) supplying a flow of pressurized cryogen and particulate media to the throwing wheel means, and operating the throwing wheel means to project pressurized cryogen and particulate media into the treatment chamber to impact such workpieces as are being tumbled about therein as the container is being rotated;

(g) withdrawing cryogen gas from the container along a path of flow defined by a withdrawal conduit during the time when the workpieces are being tumbled within the container and are being subjected to a flow of pressurized cryogen and particulate media being projected from the throwing wheel means, ducting the withdrawn cryogen gas along said path of flow to the input of a blower, operating the blower to pressurize the withdrawn cryogen gas, and ducting the pressurized cryogen gas through a supply conduit for return to the throwing wheel means;

(h) introducing a metered flow of particulate media into the supply conduit from a supply hopper for delivery to the throwing wheel means in combination with the flow of pressurized cryogen being delivered to the throwing wheel means through the supply conduit; and, (i) during all of the foregoing steps, introducing flows of a purging gas into the supply hopper, and into the withdrawal conduit to maintain positive pressure atmosphere therein.

31. The method of claim 30 wherein:

(a) the method additionally includes the steps of:
  (i) withdrawing a flow of particulate material along a passage from the container during the time when workpieces are being tumbled in the container and are being subjected to a flow of pressurized cryogen and particulate media from the throwing wheel means, the flow of withdrawn particles including reusable particulate media and pieces of flash removed from the workpieces;
  (ii) ducting the flow of withdrawn particulates to a separation apparatus, and operating the separation apparatus to segregate reusable particulate media from the flow of withdrawn particulates; and, (b) the step of introducing flows of purging gas includes the step of introducing a flow of said purging gas into the separator means to maintain a positive pressure atmosphere in the passage and in the separation apparatus during all of the foregoing steps.

32. The method of claim 30 additionally including the steps of:

(a) providing a pivotal connection between the upstanding frame and the receptacle assembly for permitting movement of the receptacle assembly relative to the frame between positions wherein the access opening of the container is oriented relatively upwardly, and a position wherein the access opening of the container is oriented relatively downwardly;

(b) positioning the receptacle assembly relative to the frame such that the access opening of the container is oriented relatively upwardly for charging the container with workpieces to be deflashed;

(c) positioning the receptacle assembly such that the access opening is oriented relatively downwardly to effect removal of deflashed workpieces from the container;

(d) during all of the foregoing steps, maintaining a positive pressure atmosphere within the container; and, (e) when the access opening is opened by moving the closure to an open position, introducing a flow of purging gas such as nitrogen directly into the treatment chamber to prevent entry into the treatment chamber through the open access opening of moisture laden ambient air.

* * * * *